US006827336B2

(12) United States Patent
Hwang

(10) Patent No.: US 6,827,336 B2
(45) Date of Patent: Dec. 7, 2004

(54) CONCRETE FENCING SYSTEM

(75) Inventor: Byung Sun Hwang, Austin, TX (US)

(73) Assignee: Byung-Sun Hwang, Austin, TX (US)

( * ) Notice: Subject to any disclaimer, the term of this patent is extended or adjusted under 35 U.S.C. 154(b) by 139 days.

(21) Appl. No.: 10/079,345

(22) Filed: Feb. 20, 2002

(65) Prior Publication Data

US 2003/0189198 A1 Oct. 9, 2003

Related U.S. Application Data

(60) Provisional application No. 60/333,923, filed on Nov. 28, 2001.

(51) Int. Cl.[7] ..... E04H 17/16

(52) U.S. Cl. ..... 256/24; 256/65.01; 256/65.02

(58) Field of Search ..... 256/19, 24, 25, 256/59, 65.01, 65.02, 65.08, 65.11, 70, 65.03, 65.05, 65.06, 65.1; 403/243, 241, 242, 244, 187, 188, 239

(56) References Cited

U.S. PATENT DOCUMENTS

| | | | | | |
|---|---|---|---|---|---|
| 829,397 | A | | 8/1906 | Gerbel | |
| 1,441,724 | A | * | 1/1923 | Ferris | 256/25 X |
| 1,503,902 | A | | 8/1924 | Jones | |
| 2,574,711 | A | | 11/1951 | Rose | |
| D182,462 | S | | 4/1958 | Gallion | |
| 3,193,255 | A | | 7/1965 | Burdett | |
| 3,393,896 | A | | 7/1968 | Poland | |
| 3,822,053 | A | * | 7/1974 | Daily | 256/65.11 X |
| 4,193,584 | A | | 3/1980 | Wieser | |
| 4,200,260 | A | * | 4/1980 | Dailey et al. | 256/24 |
| 4,289,302 | A | * | 9/1981 | Montgomery | 256/19 |
| 4,364,546 | A | * | 12/1982 | Lyman et al. | 256/24 |
| 4,369,953 | A | * | 1/1983 | Greiner et al. | 256/24 |
| 4,477,058 | A | * | 10/1984 | Lowery | 256/19 |
| 4,674,593 | A | | 6/1987 | McCarty | |
| 5,445,362 | A | * | 8/1995 | Reppert | 256/24 |
| 5,492,307 | A | * | 2/1996 | Begue et al. | 256/19 |
| 5,702,090 | A | * | 12/1997 | Edgman | 256/19 |
| 5,735,310 | A | * | 4/1998 | Hipshire | 256/66 |
| 6,126,145 | A | * | 10/2000 | Mohr | 256/24 |
| 6,199,831 | B1 | | 3/2001 | Patrick et al. | |
| 6,293,523 | B1 | * | 9/2001 | Fendler | 256/24 X |
| 6,311,957 | B1 | * | 11/2001 | Driscoll et al. | 256/65.05 |
| 6,517,056 | B2 | * | 2/2003 | Shepherd | 256/24 |

FOREIGN PATENT DOCUMENTS

EP 0 282 269 A2 9/1988

* cited by examiner

*Primary Examiner*—Anthony Knight
*Assistant Examiner*—Ryan M. Flandro
(74) *Attorney, Agent, or Firm*—Bracewell & Patterson, L.L.P.

(57) ABSTRACT

A concrete fencing system uses a pair of end posts to support a pair of rails, which support a plurality of panels. The end posts and rails have rectangular cross-sections. Each end post has a blind hole and a notch, and each rail has a longitudinal slot. One section of the fencing system is constructed by setting a pair of the end posts in the ground. A lower rail is mounted between the lower ends of the end posts in their blind holes with its slot facing upward. An upper rail is mounted between the upper ends of the end posts in their notches with its slot facing downward. A set of the panels are placed between the end posts and seated in the slots of the rails to form a wall. No additional mechanical fasteners are required to join any of these components.

1 Claim, 5 Drawing Sheets

CONCRETE FENCING SYSTEM

This patent application is based upon U.S. Provisional Patent Application No. 60/333,923, filed Nov. 28, 2001, entitled, "Concrete Fencing System", for which priority is hereby claimed.

BACKGROUND OF THE INVENTION

1. Technical Field

The present invention relates in general to an improved fencing system, and in particular to an improved concrete fencing system.

2. Description of the Prior Art

In the prior art, a number of patents have been issued for concrete fencing systems. For example, in U.S. Pat. No. 6,199,832, a column and panel concrete fence utilizing a single panel that extends between two vertical columns is disclosed. Because of the very large and heavy nature of the single panel, an extensive system of mechanical fasteners is required to secure the structure. Another example is found in U.S. Pat. No. 4,193,584. That patent shows and describes concrete columns and posts having slots for receiving concrete panels between the posts. Like the first patent, the structure is large, cumbersome, and heavy.

Several fencing systems have been designed to reduce the size and weight of the individual components. For example, U.S. Pat. Nos. 3,193,255; 4,674,593; 2,574,711; and 892,397, each disclose end posts that support a plurality of horizontal rails therebetween. However, each of these references require the rails to be fully supported on the end posts themselves, or in longitudinal vertical slots along the end posts. Still other patents, such as U.S. Pat. No. 1,503,902, and European Patent Application No. 282,269, disclose smaller panels that are mounted to rails. Unfortunately, each of these patents requires large numbers of discrete mechanical fasteners and/or additional hardware on the end posts to support the rails. Thus, an improved, simplified concrete fencing structure would be desirable.

SUMMARY OF THE INVENTION

One embodiment of a concrete fencing system uses a pair of end posts to support a pair of rails, which then support a plurality of panels. Each of these components is formed from reinforced concrete. The end posts and the rails are elongate members having generally rectangular longitudinal, lateral, and cross-sectional profiles. The lower portions of the end posts are located in underground foundations. Each end post has a blind hole and a notch, and each rail has a longitudinal slot.

One section of the fencing system is constructed by setting a pair of the end posts in the ground. A lower rail is mounted between the lower ends of the end posts in their blind holes, such that its slot faces vertically upward. An upper rail is mounted between the upper ends of the end posts in their notches, such that its slot faces vertically downward. A set of the panels are placed between the end posts and seated in the slots of the rails to form a wall. No additional mechanical fasteners are required to join any of these components.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above maybe had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT OF THE PRESENT INVENTION

Figure 1:
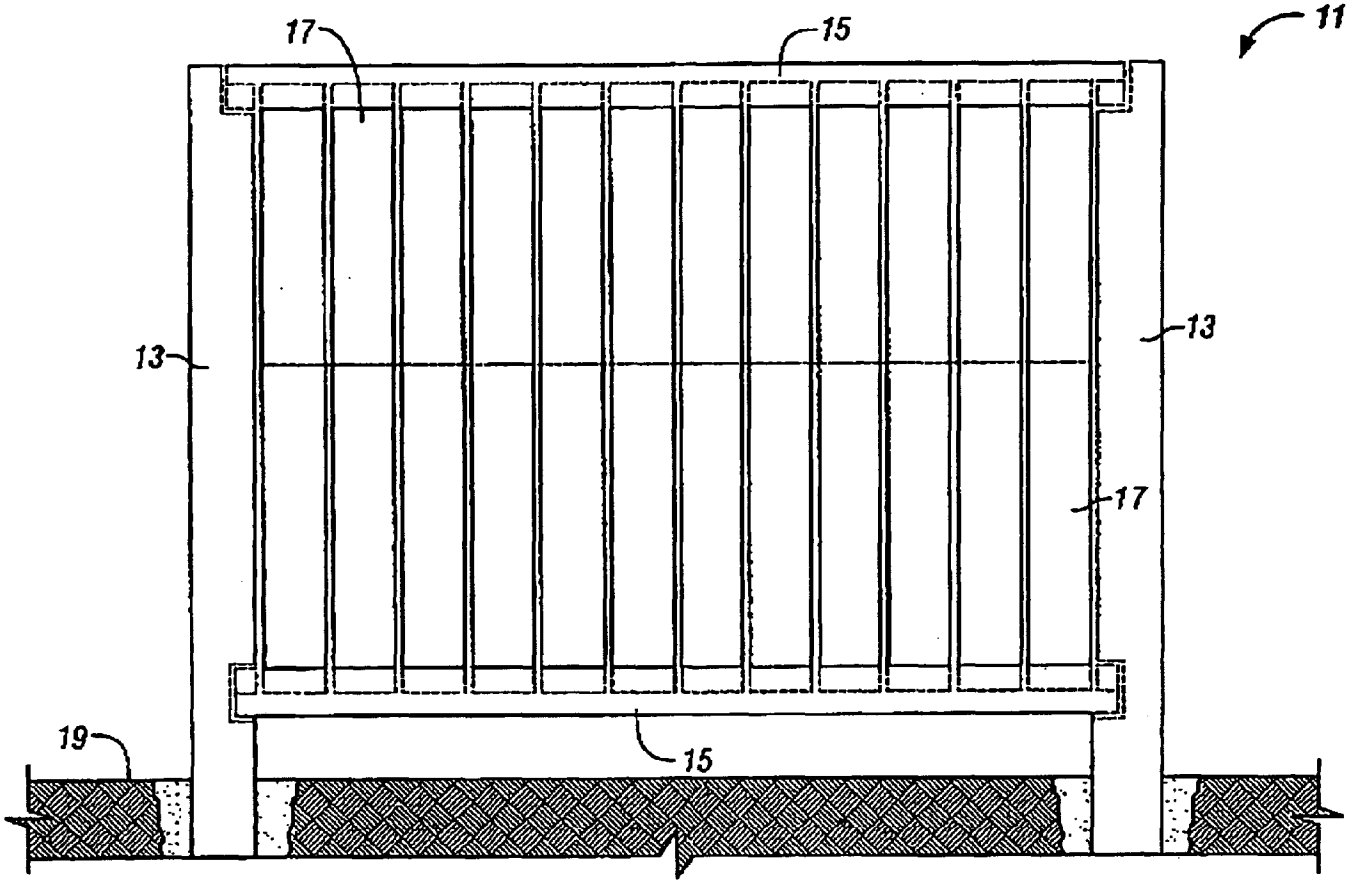
FIG. 1 is a front view of one embodiment of a concrete fencing system constructed in accordance with the present invention.

Referring to FIG. 1, a first embodiment of a concrete fencing system 11 constructed in accordance with the present invention is shown. For simplicity, only one section of fencing system 11 is illustrated in order to more clearly demonstrate its unique features and construction. The version shown is particularly well suited for residential use. However, fencing system 11 is not limited to this one application and may be readily extended or expanded into many different configurations for a variety of permanent concrete fencing applications.

The section of fencing system 11 depicted in FIG. 1 comprises a combination of only three major components: an end post 13, a rail 15, and a panel 17. As will be discussed in greater detail below, a pair of the end posts 13 support a pair of the rails 15, which in turn are used to capture and support a plurality of the panels 17. Each component is preferably formed from the same type of concrete and is preferably reinforced with metallic elements, such as steel rebar (not shown). A more thorough discussion of each of the individual components follows.

Figure 2:
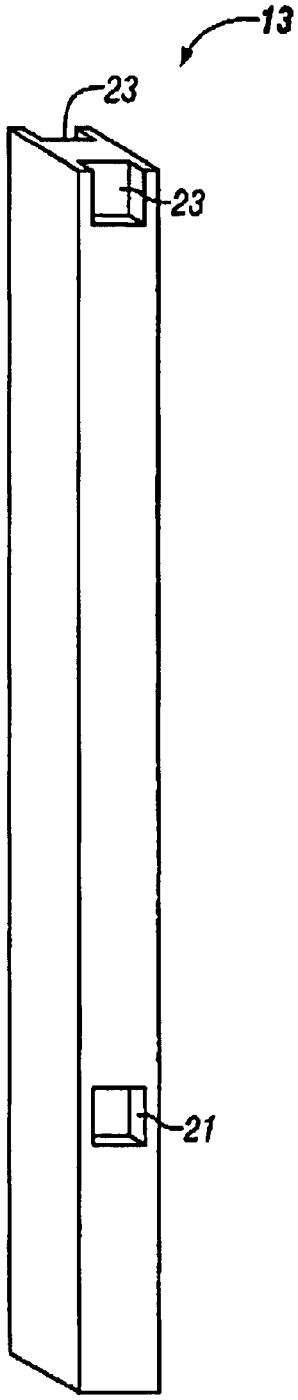
FIG. 2 is an isometric view of an end post utilized by the concrete fencing system of FIG. 1.

Referring now to FIG. 2, an isometric view of one end post 13 utilized by the first embodiment of concrete fencing system 11 of FIG. 1 is shown. End post 13 an elongate member having generally rectangular longitudinal, lateral, and cross-sectional profiles. In the version illustrated, end post 13 has an overall length of approximately 90 inches, with an intended above-ground length dimension of approximately 72 inches. Thus, the lower approximately 18 inches of end post 13 are intended to be placed in an underground foundation (see FIG. 1). Ideally, end-post 13 is approximately six inches square.

End post 13 is provided with a rectangular blind hole 21 that is approximately four inches square and one inch deep.

Blind hole 21 is located in at least one longitudinal surface of end post 13 (typically, two opposite-facing surfaces that are 180 degrees apart), and is laterally centered adjacent to the lower end of end post 13. Blind hole 21 is at least 18 inches from the lower end of end post 13 so that it will be above-ground when end post 13 is installed in a foundational substrate.

In addition, end post 13 also has at least one generally rectangular notch 23 that is laterally centered at its upper end. End post 13 typically will have two symmetric notches 23 located in opposite facing surfaces, as illustrated in FIG. 2. Each notch 23 is approximately four inches square, one inch deep, and is open and flush with the upper end of end post 13.

Figure 3:
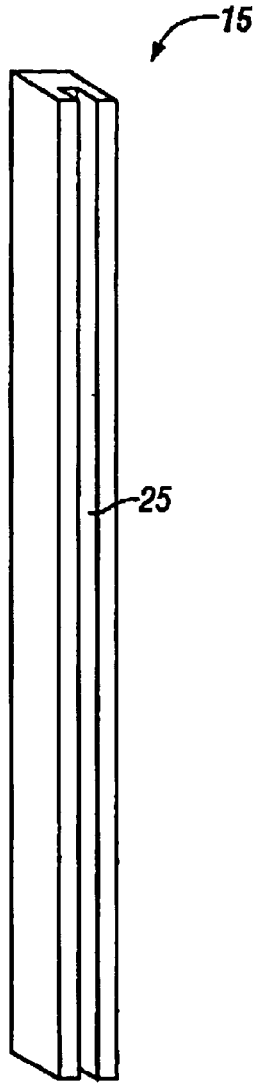
FIG. 3 is an isometric view of a rail utilized by the concrete fencing system of FIG. 1.
Figure 4:
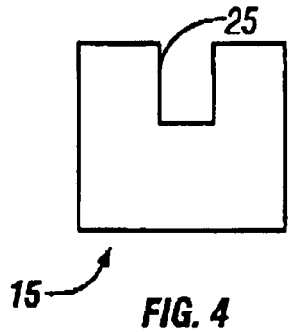
FIG. 4 is a sectional end view of the rail of FIG. 3.

As shown in FIGS. 3 and 4, the second major component utilized by the concrete fencing system 11 of FIG. 1 is rail 15. Rail 15 is also an elongate member having generally rectangular longitudinal, lateral, and cross-sectional profiles. In the version illustrated, rail 15 has an overall length of approximately 74 inches, and is approximately four inches square. Rail 15 is provided with a laterally centered, rectangular slot 25 that extends symmetrically along one its longitudinal surfaces from end to end. Slot 25 is approximately one inch square with both ends and one side open.

The third major component of fencing system 11 is panel 17, which is depicted only in FIG. 1. Panel 17 is a generally flat rectangular member having a length of approximately 66.5 inches, a width of about six inches, and a thickness of about one inch. In each section of fencing system 11, a set of the panels 17 is designed to be arrayed in a planar orientation. In this version, each individual panel 17 is adjacent to or abuts two other panels 17 along their thin edges, other than the two panels 17 adjacent to end posts 13.

Figure 5:
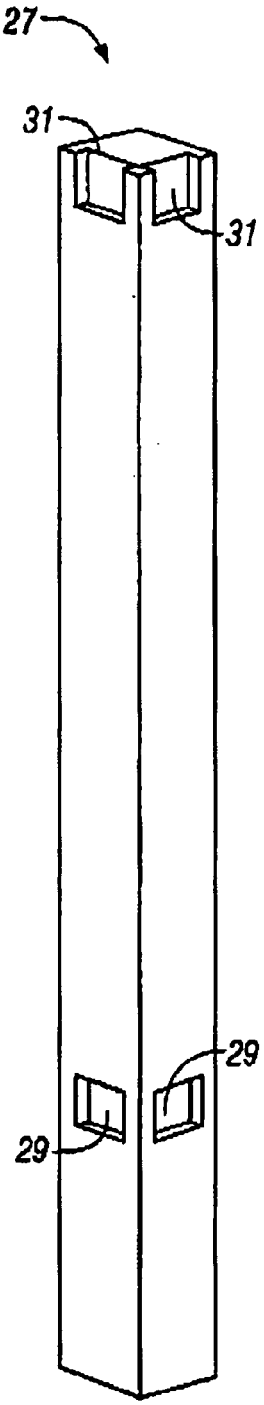
FIG. 5 is an isometric view of an optional corner post utilized by the concrete fencing system of FIG. 1.

Referring now to FIG. 5, an optional corner post 27 that may be utilized by the concrete fencing system of FIG. 1 is shown. Corner post 27 is designed to secure and support two sections of fencing system 11 that meet at an approximately perpendicular angle. In contrast, end posts 13 are designed to support adjoining sections of fencing system 11 that are substantially parallel to each other. Naturally, sections of fencing system 11 that intersect at angles other than perpendicular or parallel, such as acute or obtuse angles, may be readily accommodated by slightly varying corner post 27 or end post 13 without departing from the scope of the present invention.

Corner post 27 is substantially identical to end post 13 in both shape and dimension, and is provided with blind holes 29 and notches 31 which are substantially identical to those previously described. However, blind holes 29 and notches 31 are located in surfaces of corner post 27 that are immediately adjacent to each other (only 90 degrees apart), rather than in opposite-facing surfaces.

In operation (FIG. 1), one section of fencing system 11 may be constructed by preparing two holes in the underlying support surface 19. A pair of end posts 13 are vertically oriented, substantially perpendicular to level ground 19 in the version shown. The lower end of each end post 13 is anchored or permanently set in each hole with a concrete foundation 31. One rail 15, hereinafter the "lower rail," is mounted between the lower ends of end posts 13 such that it extends into each of their respective blind holes 21 (in their facing surfaces). The lower rail 15 is mounted such that its slot 25 faces vertically upward. Ideally, lower rail 15 is located a few inches above the surface of ground 19. Another rail 15, hereinafter the "upper rail," is mounted between the upper ends of end posts 13 such that it extends into each of their respective notches 23. The upper rail 15 is mounted such that its slot 25 faces vertically downward. Ideally, the upper surface of upper rail 15 is substantially flush with the upper surface of end posts 13. In the configuration shown, the rails 15 are parallel to each other in a generally horizontal orientation and perpendicular to end posts 13.

In addition, a plurality of panels 17 are located between end posts 13. Panels 17 are vertically oriented and generally parallel to end posts 13, and perpendicular to rails 15. The upper ends of panels 17 are seated in the downward facing slot 25 of upper rail 15, and the lower ends of panels 17 are seated in the upward facing slot 25 of lower rail 15. Collectively, panels 17 form a flat partition or wall as they abut adjacent ones of the panels 17 and, on the ends, end posts 13. Thus, the weight of all of the panels 17 is supported by the lower rail 15 since none of the panels 17 mechanical interlock or are directly supported by end posts 13. Moreover, no additional mechanical fasteners are required to join any of these components. However, an adhesive, filler, or sealant may be used to bond the various elements of concrete fencing system 11 together to form a more rigid structure. This one illustrative embodiment of concrete fencing system 11 has an overall height of approximately 90 inches, and an approximate width of 88 inches.

Figure 6:
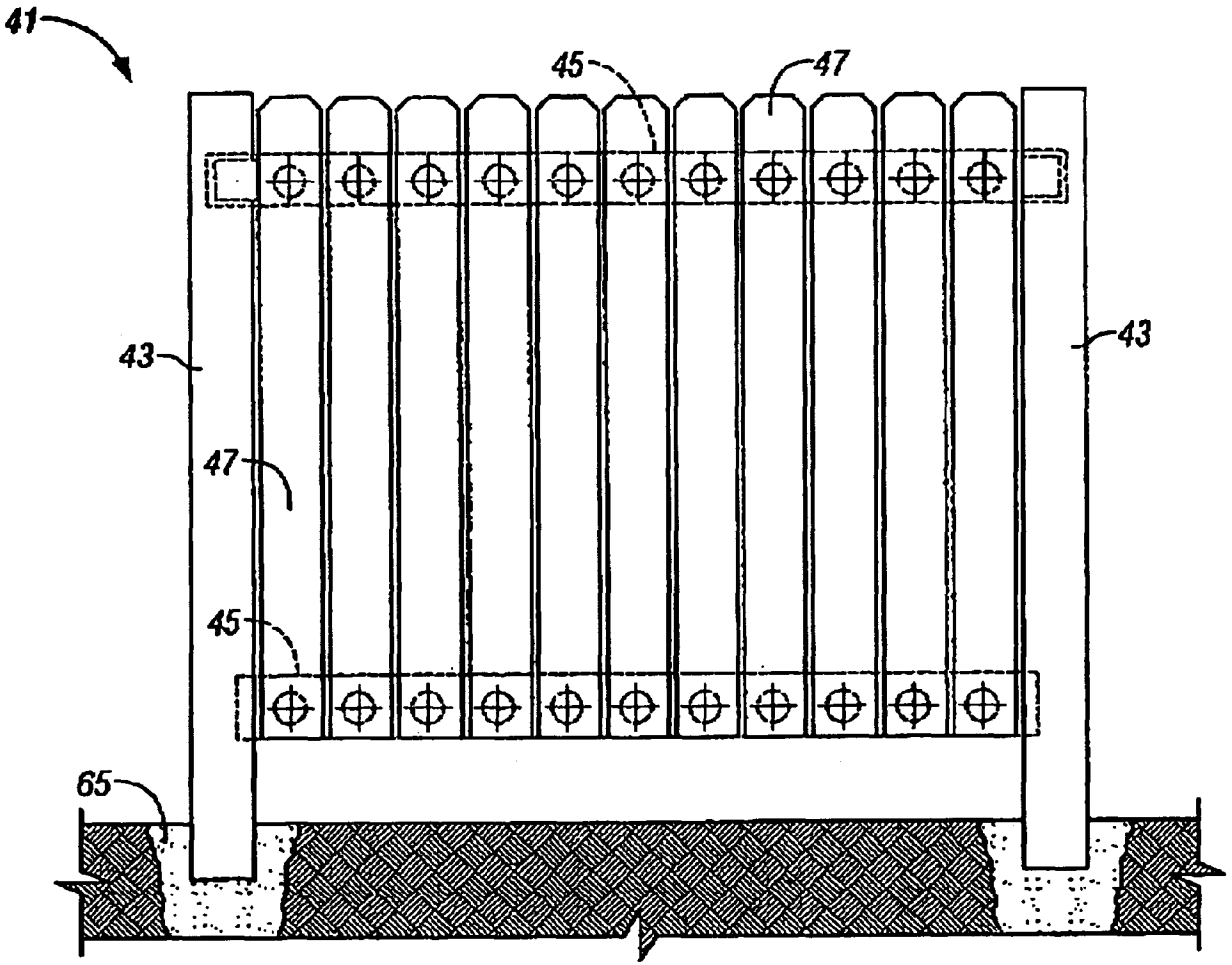
FIG. 6 is a front view of an alternate embodiment of a concrete fencing system constructed in accordance with the present invention.

Referring now to FIG. 6, a second embodiment of a concrete fencing system 41 constructed in accordance with the present invention is shown. As was the case for fencing system 11, only one section of fencing system 41 is illustrated, but it readily adaptable for other applications. Also like fencing system 11, fencing system 41 has three major components: an end post 43, a rail 45, and a panel 47, all of which are preferably formed from the same type of reinforced concrete.

Figure 7:
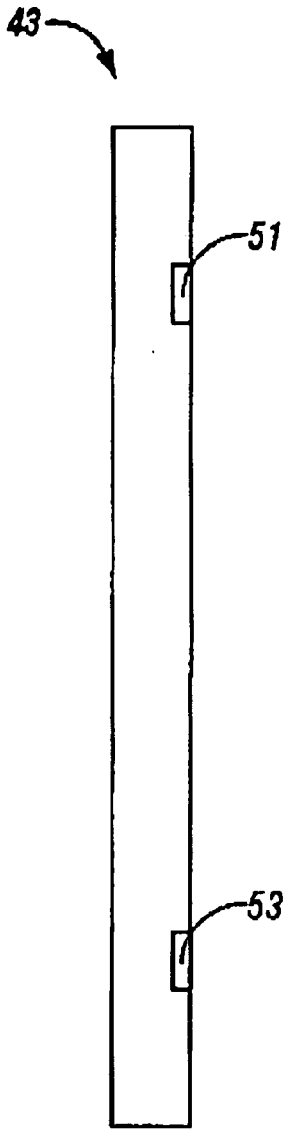
FIG. 7 is a front view of an end post utilized by the concrete fencing system of FIG. 6.
Figure 8:
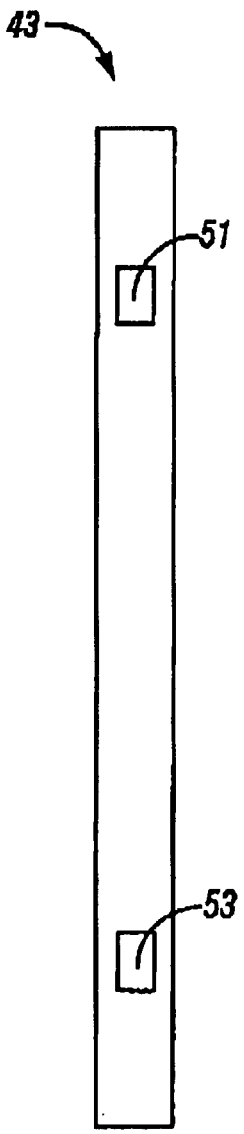
FIG. 8 is a side view of the end post of FIG. 7.

Referring now to FIGS. 7 and 8, end post 43 is very similar to end post 13 with generally rectangular longitudinal, lateral, and cross-sectional profiles. In the version illustrated, end post 43 has a length of approximately 90 inches, and is approximately 5.5 inches square. End post 43 has two rectangular blind holes 51, 53, each of which is approximately four inches by 2.5 inches, and about 1.5 inches deep. Blind holes 51, 53 are located in at least one longitudinal surface of end post 43 (usually two opposite-facing surfaces), and are laterally centered near the upper and lower ends, respectively, of end post 43. Blind hole 51 is about 12 inches from the upper end of end post 43, and blind hole 53 is about 30 inches from the lower end of end post 43.

Figure 9:
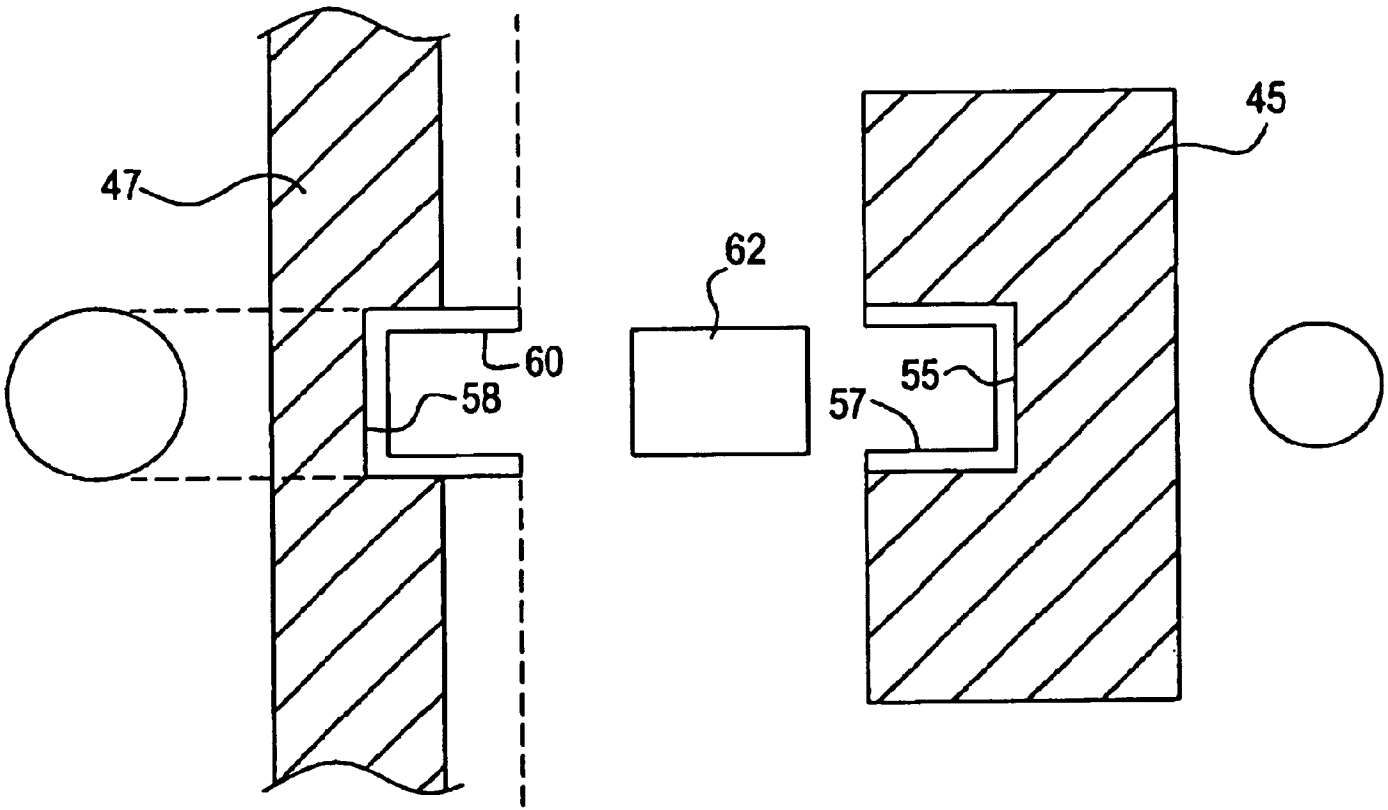
FIG. 9 is an exploded side view of various components of the fencing system of FIG. 6.

As shown in FIGS. 6 and 9, the second major component of fencing system 41 is rail 45. Rail 45 has rectangular longitudinal, lateral, and cross-sectional profiles and is approximately two by four inches in section. Rail 45 has a row of equally spaced-apart blind cylindrical holes 55 that are laterally centered along one longitudinal surface of rail 45. Holes 55 are approximately 1.2 inches in diameter and about one inch deep. Each hole 55 may be lined with a thin cylindrical insert 57. Inserts 57 have an approximately one inch internal diameter and are only one or two inches long.

The third major component of fencing system 41 is panel 47. Panel 47 is a generally flat rectangular, preferably dog-eared picket having a thickness of about 1.7 inches. Each panel has a pair of cylindrical blind holes 58 with thin inserts 60, as described above. However, inserts 60 protrude slightly from the outer surface of panels 47, as shown. In each section of fencing system 41, a set of panels 47 is designed to be arrayed in a planar orientation. In this version, each individual panel 47 is adjacent to or abutting two other panels 47 along their thin edges, other than the two panels 47 adjacent to end posts 43. Fencing system 41 also uses a small puck or cylinder 62 (approximately 0.9 inches in diameter) between inserts 57, 60 to join rails 45 to panels 47. Thus, when fully assembled, cylinder 62 is coaxially with and located in both holes 55, 57, via inserts 57, 60, respectively.

Figure 10:
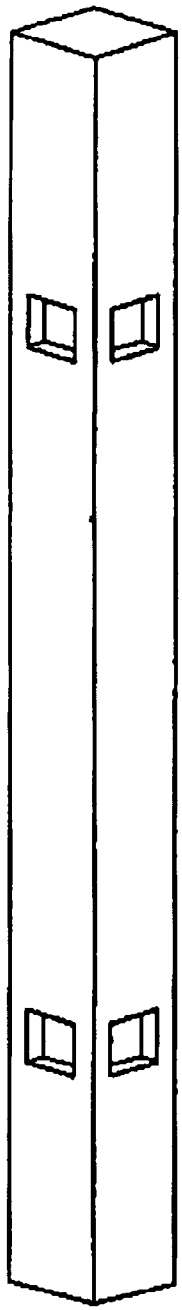
FIG. 10 is an isometric view of an optional corner post utilized by the concrete fencing system of FIG. 6.

Referring now to FIG. 10, an optional corner post 59 that is analogous to corner post 27 is shown. Corner post 59 is substantially identical to end post 43 in both shape and dimension, and is provided with blind holes 61, 63 which are substantially identical to holes 51, 53. However, blind holes 61, 63 are located in surfaces of corner post 59 that are immediately adjacent to each other, rather than in opposite-facing surfaces.

In operation (FIG. 6), one section of fencing system 41 may be constructed by preparing two holes in the underlying support surface 65. One end posts 43 is vertically anchored in each hole with a concrete foundation 67. One rail 45, hereinafter the "lower rail," is mounted between the lower ends of end posts 43 such that it extends into each of their respective blind holes 53. The lower rail 45 is mounted such that its holes 55 face forward as shown. Another rail 45, hereinafter the "upper rail," is mounted between the upper ends of end posts 43 such that it extends into each of their respective holes 51. The upper rail 45 is mounted such that its holes 55 face in the same direction as the other holes 55. In the configuration shown, the rails 45 are parallel to each other in a generally horizontal orientation and perpendicular to end posts 43.

In addition, a plurality of panels 47 are joined to each of the rails 45 with cylinders 62. Panels 47 are vertically oriented and generally parallel to end posts 43, and perpendicular to rails 45. Collectively, panels 47 form a flat partition or wall. Thus, the weight of all of the panels 47 is supported by both rails 45 since none of the panels 47 mechanical interlock or are supported by end posts 43. Moreover, no additional mechanical fasteners are required to join any of these components. However, an adhesive may be used to bond the various elements of concrete fencing system 41 together to form a more rigid structure.

The present invention has several advantages including a very efficient structural design that is far less complex than conventional prior art designs. The concrete fencing system disclosed herein requires no additional mechanical fasteners such as bolts, screws, or clips, thereby expediting assembly in each application. In addition, the elements of Applicant's invention are capable of being bonded together with adhesive. Utilizing concrete as the material from which all of the components of the fencing system are formed greatly enhances the expected useful life of the product many times longer than conventional timber-based fencing systems.

While the invention has been shown or described in only some of its forms, it should be apparent to those skilled in the art that it is not so limited, but is susceptible to various changes without departing from the scope of the invention.

What is claimed is:

1. A concrete fencing system, comprising:

a plurality of end posts, each having a pair of upper rail openings located adjacent to one end of the end posts, and a pair of lower rail openings located adjacent to an opposite end of the end posts, wherein the upper and lower rail openings are located on facing surfaces of the end posts;

an upper rail extending between each adjacent pair of the end posts, wherein the upper rails terminate in the upper rail openings such that the rails are fully supported by the end posts within the upper rail openings;

a lower rail extending between each adjacent pair of the end posts, wherein the lower rails terminate in the lower rail openings such that the rails are fully supported by the end posts within the lower rail openings;

a plurality of panels mounted directly to and fully supported by only the rails, wherein the panels and the rails have vertical facing surfaces that abut each other;

inserts located in each of the rails and in each of the panels, wherein axially adjacent ones of the inserts extend horizontally toward each other in a coaxial relationship;

pucks for joining the rails and the panels via the inserts, such that the pucks and inserts are void of threaded fasteners for securing the panels to the rails;

a bond located between the end posts, rails, and panels to form a more rigid structure, wherein the bond is selected from a group consisting of an adhesive, a filler, and a sealant; and wherein the inserts located in the rails protrude outward from the vertical facing surfaces of the rails; and the inserts are hollow cylinders, the pucks are cylinders, and the pucks are mounted inside said axially adjacent ones of the inserts.

* * * * *